US007360681B2

(12) United States Patent
Pittman et al.

(10) Patent No.: US 7,360,681 B2
(45) Date of Patent: Apr. 22, 2008

(54) MULTI-UNIT MAIL RECEPTACLE SYSTEM

(75) Inventors: Larry D. Pittman, Boiling Springs, SC (US); B. Stewart Jackson, Spartanburg, SC (US)

(73) Assignee: Bommer Industries Inc., Landrum, SC (US)

( * ) Notice: Subject to any disclaimer, the term of this patent is extended or adjusted under 35 U.S.C. 154(b) by 0 days.

(21) Appl. No.: 11/708,303

(22) Filed: Feb. 20, 2007

(65) Prior Publication Data

US 2007/0194096 A1 Aug. 23, 2007

Related U.S. Application Data

(60) Provisional application No. 60/775,378, filed on Feb. 21, 2006.

(51) Int. Cl.
*B65G 11/04* (2006.01)

(52) U.S. Cl. ..... 232/45; 232/24; 16/254; 312/109; 312/329; 220/841

(58) Field of Classification Search ..... 232/45, 232/24, 25; 16/254, 267, 271, 272; 312/329, 312/109, 211, 293.2; 220/820, 841
See application file for complete search history.

(56) References Cited

U.S. PATENT DOCUMENTS 1,186,637 A * 6/1916 Williams ..... 16/272
2,302,661 A * 11/1942 Benson ..... 16/267
2,960,265 A 11/1960 Simon
3,784,089 A 1/1974 Koch
3,834,612 A 9/1974 Bixby
4,161,274 A 7/1979 Bishop et al.
4,416,413 A 11/1983 Chester
4,865,248 A 9/1989 Barth
5,794,844 A * 8/1998 Jenkins ..... 232/25
5,971,515 A 10/1999 Baker et al.
6,328,205 B1 12/2001 Noblet et al.

* cited by examiner

*Primary Examiner*—William L. Miller
(74) *Attorney, Agent, or Firm*—Leydig, Voit & Mayer, Ltd.

(57) ABSTRACT

A mail receptacle system incorporating multiple individually accessible discrete storage compartments disposed within a frame structure with lockable user access doors disposed in mated hinging relation relative to the frame structure such that when the access doors are in a closed position, a male/female relation is established between portions of the doors and the frame structure. The access doors utilize a multi-piece construction wherein the hinging edges of the doors are displaceable from the door body thereby permitting the door body to be easily and readily replace in the event of damage.

17 Claims, 5 Drawing Sheets

MULTI-UNIT MAIL RECEPTACLE SYSTEM

CROSS-REFERENCE TO RELATED APPLICATIONS

This application claims the benefit of provisional application 60/775,378 filed on Feb. 21, 2006, the contents of which are hereby incorporated by reference in their entirety as if fully set forth herein.

TECHNICAL FIELD

This invention relates generally to mail receptacle systems incorporating multiple individually accessible discrete storage compartments incorporating lockable user access doors adapted to open and close relative to the storage compartments.

SUMMARY OF THE INVENTION

The present invention provides advantages and alternatives over the prior art by providing a mail receptacle system incorporating multiple individually accessible discrete storage compartments disposed within a frame structure with lockable user access doors disposed in mated hinging relation relative to the frame structure such that when the access doors are in a closed position, a male/female relation is established between portions of the doors and the frame structure. The male/female relation substantially prevents pry tool access thereby enhancing security. The access doors utilize a multi-piece construction wherein the hinging edges of the doors are displaceable from the door body thereby permitting the door body to be easily and readily replace in the event of damage.

BRIEF DESCRIPTION OF THE DRAWINGS

The present invention will be described by way of example only, with reference to the accompanying drawings which are incorporated in and which constitute a part of this specification herein and together with the general description of the invention given above, and the detailed description set forth below, serve to explain the principles of the invention wherein.

Figure 1:
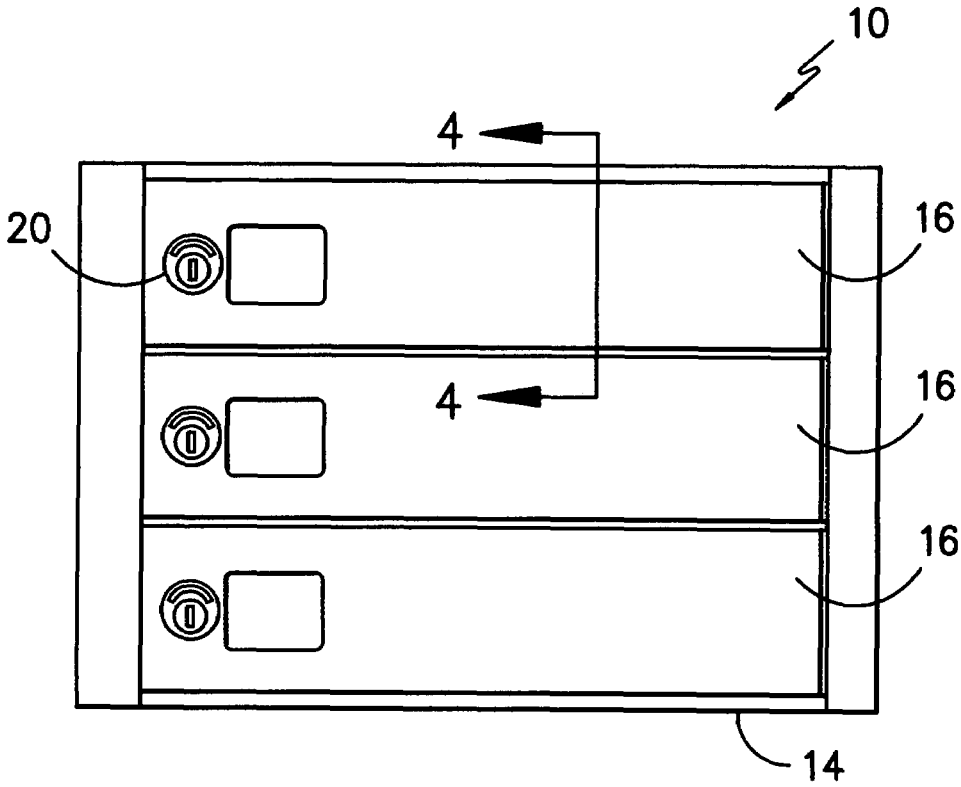
FIG. 1 is a face view of a multi-unit mail receptacle unit with the doors closed.

While the invention has been illustrated and generally described above and will herein after be described in connection with certain potentially preferred embodiments and practices, it is to be understood that in no event is the invention limited to such illustrated and described embodiments and practices. On the contrary it is intended that the present invention shall extend to all alternatives and modifications as may embrace the general principles of this invention within the full and true spirit and scope thereof.

DETAILED DESCRIPTION

Reference will now be made to the drawings, wherein like elements are designated by like reference numerals in the various views. It is to be understood that any dimensions provided are illustrative only and are subject to variation as may be desired.

Referring to FIG. 1, a multi-compartment mail receptacle unit 10 is illustrated having an arrangement of stacked compartments disposed within a supporting frame structure 14. The compartments are enclosed by displaceable access doors 16 that may be opened by individual users by manipulation of an access lock 20 so as to pivot around hinge pins 22 (FIG. 2) extending through hinge pin openings 23 (FIGS. 5-7) or other hinge-forming structures as may be utilized.

Figure 2:
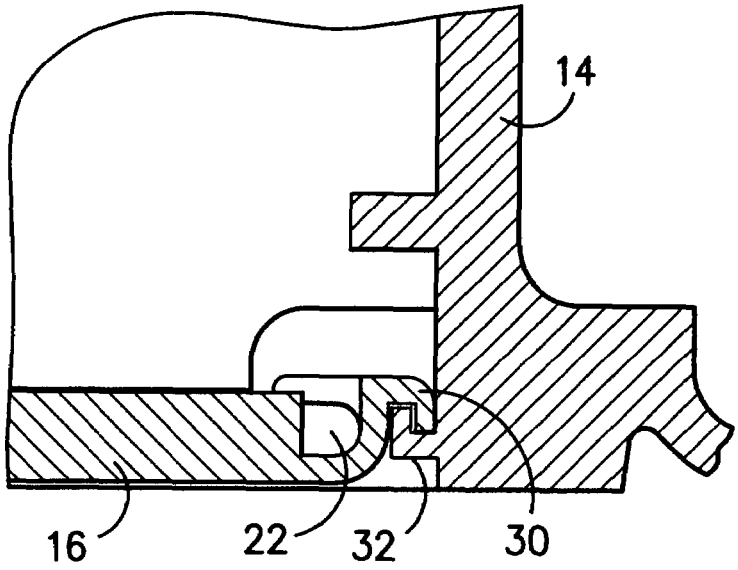
FIG. 2 is a magnified view of a hinging edge of a unit door.
Figure 5:
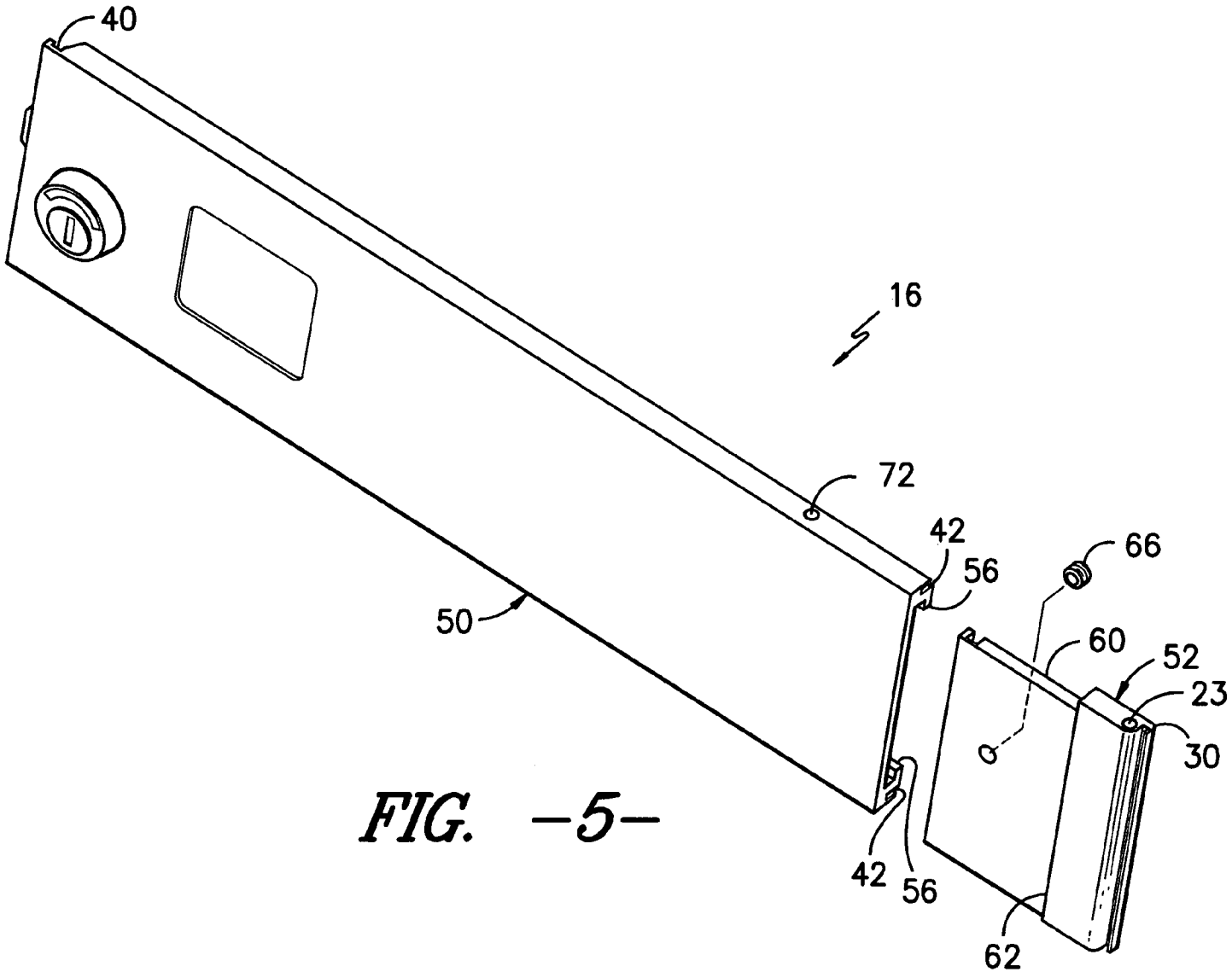
FIG. 5 is an exploded front perspective view of unit door illustrating the multi-piece construction.

As best illustrated through reference to FIGS. 2 and 5, the door 16 includes a substantially "U" shaped edge 30 adjacent the hinge line that is adapted to engage a complementary "L" shaped ear 32 projecting inwardly from the frame structure 14. Thus, when the door 16 is in the closed position shown in FIG. 2, the ear 32 is mated at the interior of the "U" shaped door edge. This male/female mating relationship substantially prevents any insertion of a pry tool at the hinge edge when the door 16 is in a closed position. At the same time, the door may be freely pivoted in a counterclockwise direction as the door is opened.

Figure 3:
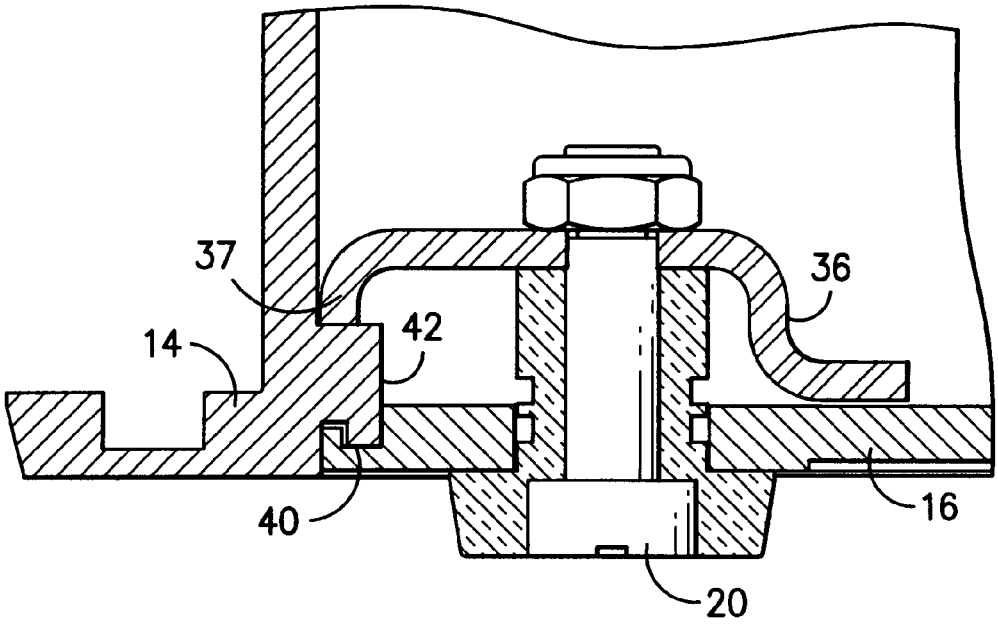
FIG. 3 is a magnified view of a lock portion of a unit door.

As best illustrated through in FIG. 3, the door 16 supports an access lock 20 such as a commercial key operated lock or the like. When the access lock 20 is rotated, the retainer elements 36, 37 are moved out of blocking relation relative to the frame structure 14 and the door 16 may be swung outwardly. As illustrated, the displaceable edge of the door 16 is provided with a substantially "U" shaped depression 40 that is adapted to receive a complementary projection along the edge of the frame structure 14. As illustrated, this male/female engagement substantially blocks any insertion of a pry tool along the displaceable edge when the door is in a closed position. At the same time, the door may be freely pivoted in a counterclockwise direction as the door is opened.

Figure 4:
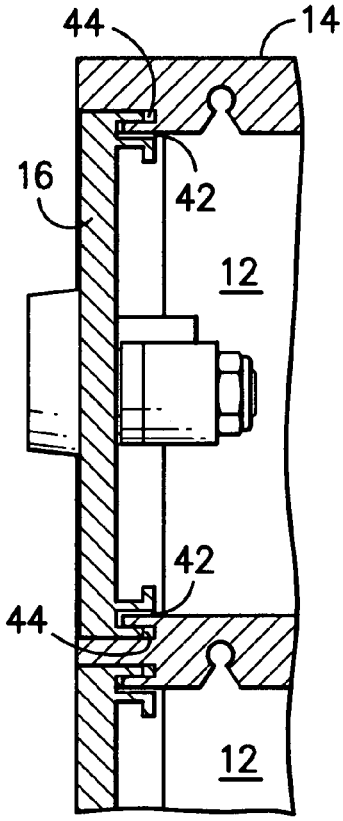
FIG. 4 is a view taken generally along line 4-4 in FIG. 1 showing the unit door in closed relation with the mail receptacle frame.
Figure 4A:
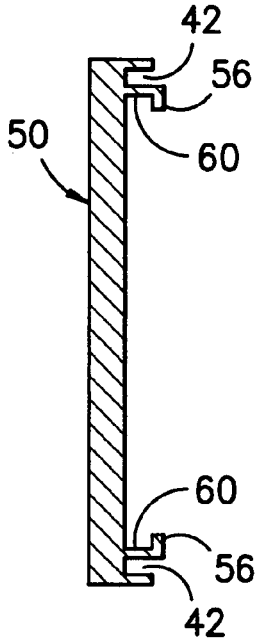
FIG. 4A is a cross-section of the unit door body alone.

As best illustrated in FIGS. 4 and 4A, the top and bottom of the door 16 preferably include slots 42 defining acceptance channels adapted to receive projecting edges 44 running along the upper and lower edges of the compartments 12. As illustrated, this male/female engagement substantially blocks any insertion of a pry tool along the upper and lower displaceable edge when the door is in a closed position. At the same time, the door may be freely pivoted in a counterclockwise direction as the door is opened.

Figure 6:
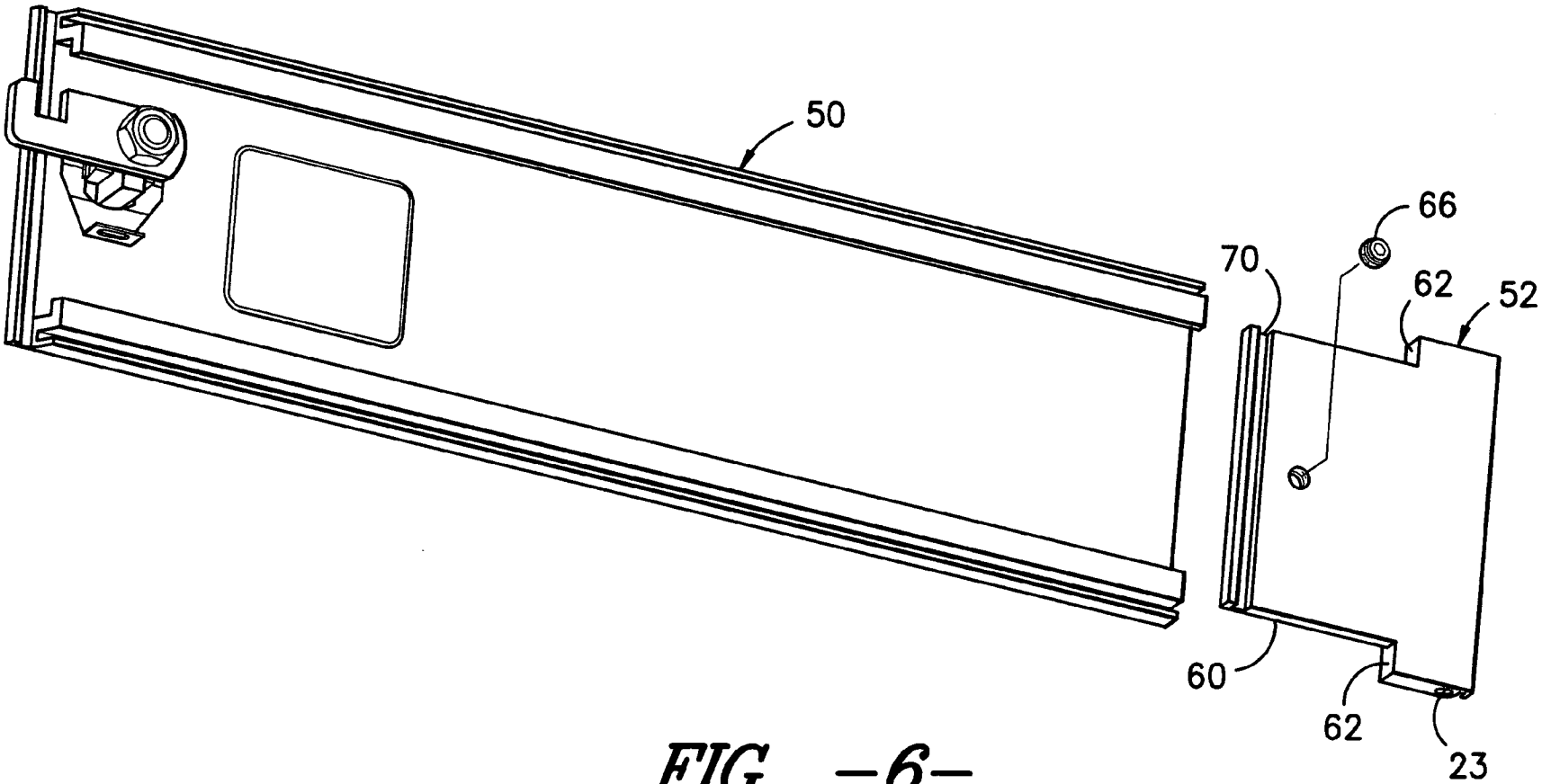
FIG. 6 is an exploded rear perspective view of unit door illustrating the multi-piece construction.
Figure 7:
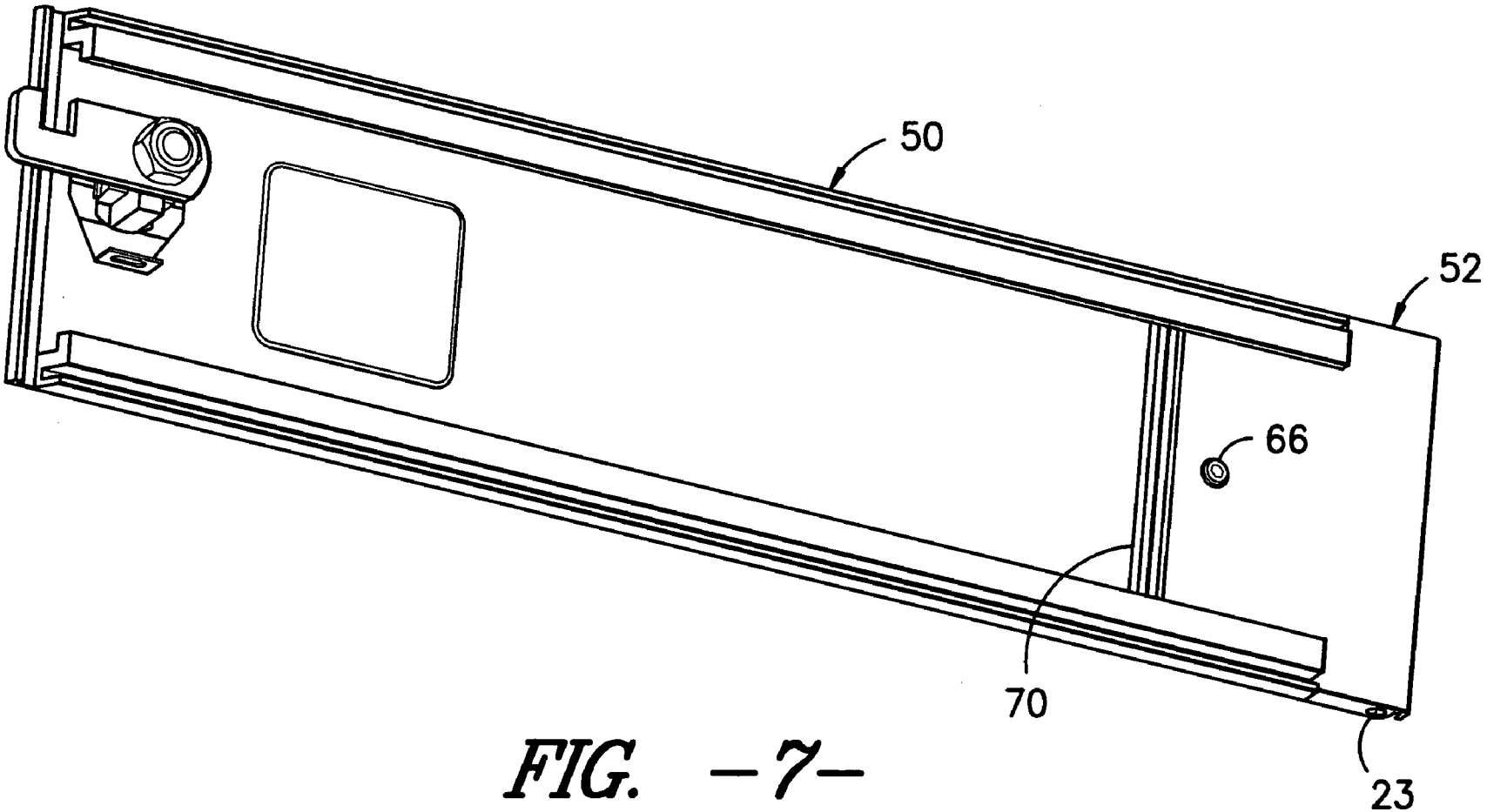
FIG. 7 is a view similar to FIG. 6 showing the unit door in fully assembled condition.

As shown in FIGS. 5-7, the door 16 is preferably of a two piece construction incorporating an elongate body portion 50 and an insertable hinge plate 52. As best illustrated in FIGS. 4A, 5 and 6, the back of the body portion preferably incorporates a pair of opposing ears 56 offset from the face plate of the body portion and running along the top and bottom edges of the body portion 50. The ears 56 define channels for sliding acceptance of a tongue portion 60 of the hinge plate 52 such that the tongue portion 60 is held in place against the rear of the face plate by the ears 56. Proper insertion depth is established by a shoulder portion 62 at the base of the tongue portion 60 which houses the hinge pin opening 23.

Following insertion of the tongue portion 60, the hinge plate 52 may be held against sliding displacement by any suitable mechanism. By way of example only, and not limitation, in the illustrated embodiment, a set screw 66 may be inserted through an opening in the tongue portion 60 for friction and/or embedded engagement with the rear of the face plate. It is likewise contemplated that the tongue portion 60 may be provided with a pin acceptance channel 70 positioned for alignment with an optional pin opening 72 for insertion of a connecting pin (not shown) through the edge of the face plate and into the pin acceptance channel 70 when the tongue portion is fully inserted. It is also contemplated that other mechanisms such as a tight friction fit between the tongue portion 60 and the rear of the face plate may be used if desired.

Regardless of the mechanism utilized to secure the hinge plate 52 to the body portion 50 of the door, it is contemplated that such attachment will be reversible by a person having legitimate access to the interior of the door structure. This permits the body portion 50 to be readily replaced in the event of damage without the need to remove the hinge pins 22 or to disassemble the hinging mechanism.

As will be appreciated, the materials forming the door are preferably of substantial strength and corrosion resistance so as to avoid damage while at the same time being suitable for formation practices such as extrusion and the like. Extrusion of the hinge plate and body portion as independent single piece structures may be particularly preferred. Aluminum alloys may be particularly preferred although other metals may also be used if desired. Of course, it is also contemplated that other materials such as high impact plastics and the like may also be utilized if desired.

While the present invention has been illustrated and described in relation to various potentially preferred embodiments, constructions, and procedures, such embodiments, constructions, and procedures are illustrative only and that the present invention is in no event to be limited thereto. Rather, it is contemplated that modifications and variations embodying the principles of this invention will no doubt occur to those of skill in the art, therefore, it is contemplated and intended that the present invention will extend to all such modifications and variations as may incorporate the broad principles of the invention within the full spirit and scope thereof.

That which is claimed is:

1. A mail storage unit comprising a frame structure and a plurality of compartments adapted to receive mail, wherein at least a portion of the compartments include multiple piece hinging access doors, the multiple piece hinging access doors having an interior surface adapted to face towards the interior of the compartments when the access doors are in a closed position and an exterior surface adapted to face away from the interior of the compartments when the access doors are in a closed position, the multiple piece hinging access doors comprising a hinge plate and a body portion slidingly engaging the hinge plate, wherein the hinge plate comprises a shoulder portion supporting a hinge pin and a tongue portion projecting away from the shoulder portion, and wherein an interior surface of the body portion includes a channel slidingly engaging the tongue portion of the hinge plate.

2. The mail storage unit as recited in claim 1, wherein the channel is bordered by a first substantially "L" shaped ear extending substantially parallel to a top edge of the body portion and a second substantially "L" shaped ear extending substantially parallel to a bottom top edge of the body portion.

3. The mail storage unit as recited in claim 1, wherein the hinge plate is secured in place relative to the body portion by a set screw extending through an opening in the hinge plate such that the set screw engages the interior surface of the body portion.

4. The mail storage unit as recited in claim 1, wherein the access doors are formed from metal.

5. The mail storage unit as recited in claim 4, wherein said metal is an aluminum alloy.

6. The mail storage unit as recited in claim 4, wherein each of the hinge plate and the body portion comprise single piece extrusions.

7. A mail storage unit comprising a frame structure and a plurality of compartments adapted to receive mail, wherein at least a portion of the compartments include multiple piece hinging access doors, the multiple piece hinging access doors having an interior surface adapted to face towards the interior of the compartments when the access doors are in a closed position and an exterior surface adapted to face away from the interior of the compartments when the access doors are in a closed position, the multiple piece hinging access doors comprising a hinge plate and a body portion slidingly engaging the hinge plate, wherein the hinge plate comprises a shoulder portion supporting a hinge pin and a tongue portion projecting away from the shoulder portion, and wherein an interior surface of the body portion includes a channel slidingly engaging the tongue portion of the hinge plate, the shoulder portion of the hinge plate comprising a substantially "U" shaped hinging edge running substantially parallel to a channel holding the hinge pin, the substantially "U" shaped hinging edge being oriented such that it projects outwardly towards the exterior of the storage unit and wherein the frame structure includes a substantially "L" shaped edge projection including a leg projecting towards the interior of the storage unit, such that the leg projecting towards the interior of the storage unit extends into the interior of the substantially "U" shaped hinging edge when the access door is in a closed position.

8. The mail storage unit as recited in claim 7, wherein the channel is bordered by a first substantially "L" shaped ear extending substantially parallel to a top edge of the body portion and a second substantially "L" shaped ear extending substantially parallel to a bottom top edge of the body portion.

9. The mail storage unit as recited in claim 7, wherein the hinge plate is secured in place relative to the body portion by a set screw extending through an opening in the hinge plate such that the set screw engages the interior surface of the body portion.

10. The mail storage unit as recited in claim 7, wherein the access doors are formed from metal.

11. The mail storage unit as recited in claim 10, wherein said metal is an aluminum alloy.

12. The mail storage unit as recited in claim 10, wherein each of the hinge plate and the body portion comprise single piece extrusions.

13. A mail storage unit comprising a frame structure and a plurality of compartments adapted to receive mail, wherein at least a portion of the compartments include multiple piece hinging access doors, the multiple piece hinging access doors having an interior surface oriented to face towards the interior of the compartments when the access doors are in a closed position and an exterior surface oriented to face away from the interior of the compartments when the access doors are in a closed position, the multiple piece hinging access doors comprising a hinge plate and a body portion slidingly engaging the hinge plate, wherein the hinge plate comprises a shoulder portion supporting a hinge pin and a tongue portion projecting away from the shoulder portion, and wherein an interior surface of the body portion includes a channel slidingly engaging the tongue portion of the hinge plate, the shoulder portion of the hinge plate comprising a substantially "U" shaped hinging edge running substantially parallel to a channel holding the hinge pin, the substantially "U" shaped hinging edge being oriented such that it projects outwardly towards the exterior of the storage unit and wherein the frame structure includes a substantially "L" shaped edge projection including a leg projecting towards the interior of the storage unit, such that the leg projecting towards the interior of the storage unit extends into the interior of the substantially "U" shaped hinging edge when the access door is in a closed position, wherein the channel is bordered by a first substantially "L" shaped ear extending substantially parallel to a top edge of the body portion and a second substantially "L" shaped ear extending substantially parallel to a bottom top edge of the body portion, the top edge and the bottom edge of the body portion each including a raised lip such that a first groove is defined between a raised lip and the first substantially "L" shaped ear and a second groove is defined between a raised lip and the second substantially "L" shaped ear and wherein the frame structure includes outwardly extending projections along the top edge and the bottom edge of the storage compartments adapted for insertion into the first and second grooves when the access door is in a closed position.

14. The mail storage unit as recited in claim 13, wherein the hinge plate is secured in place relative to the body portion by a set screw extending through an opening in the hinge plate such that the set screw engages the interior surface of the body portion.

15. The mail storage unit as recited in claim 13, wherein the access doors are formed from metal.

16. The mail storage unit as recited in claim 15, wherein said metal is an aluminum alloy.

17. The mail storage unit as recited in claim 15, wherein each of the hinge plate and the body portion comprise single piece extrusions.

* * * * *